US005498016A

United States Patent [19]

Jodelet

[11] Patent Number: 5,498,016

[45] Date of Patent: Mar. 12, 1996

[54] PROCESS FOR MANUFACTURING A SKI INCORPORATING AN INJECTED CORE AND A PERFORATED INTERNAL REINFORCEMENT, AND SKI OBTAINED BY THIS PROCESS

[75] Inventor: François Jodelet, Voiron, France

[73] Assignee: Skis Rossignol S.A., France

[21] Appl. No.: 176,441

[22] Filed: Jan. 3, 1994

[30] Foreign Application Priority Data

Jan. 19, 1993 [FR] France ..... 93 00685

[51] Int. Cl.[6] ..... A63C 5/14

[52] U.S. Cl. ..... 280/602; 280/610

[58] Field of Search ..... 280/607, 610, 280/602, 608, 609; 264/257

[56] References Cited

U.S. PATENT DOCUMENTS

| | | | |
|---|---|---|---|
| 3,918,731 | 11/1975 | Legrand | 280/610 |
| 4,725,070 | 2/1988 | Maruyama | 280/610 |
| 5,056,807 | 10/1991 | Comert et al. | 280/610 |
| 5,186,777 | 2/1993 | Perenon et al. | 280/610 |
| 5,248,160 | 9/1993 | Le Masson et al. | 280/610 |
| 5,294,139 | 3/1994 | Cazaillon et al. | 280/610 |
| 5,393,085 | 2/1995 | Forneri | 280/610 |

*Primary Examiner*—Margaret A. Focarino
*Assistant Examiner*—Carla Mattix
*Attorney, Agent, or Firm*—Parkhurst Wendel & Rossi

[57] ABSTRACT

This invention relates to a ski incorporating an injected core and to a process for manufacturing such a ski. The ski includes an internal reinforcement of perforated, reinforced fabric which is short, located at the level of the runner, in the form of an upturned gutter and which is separated from the upper face of the ski by distance pieces in the form of beads of hot melt adhesive. When manufacturing in the mould, these beads enable the reinforcement to be pre-positioned whilst maintaining it at a distance from the upper face.

16 Claims, 7 Drawing Sheets

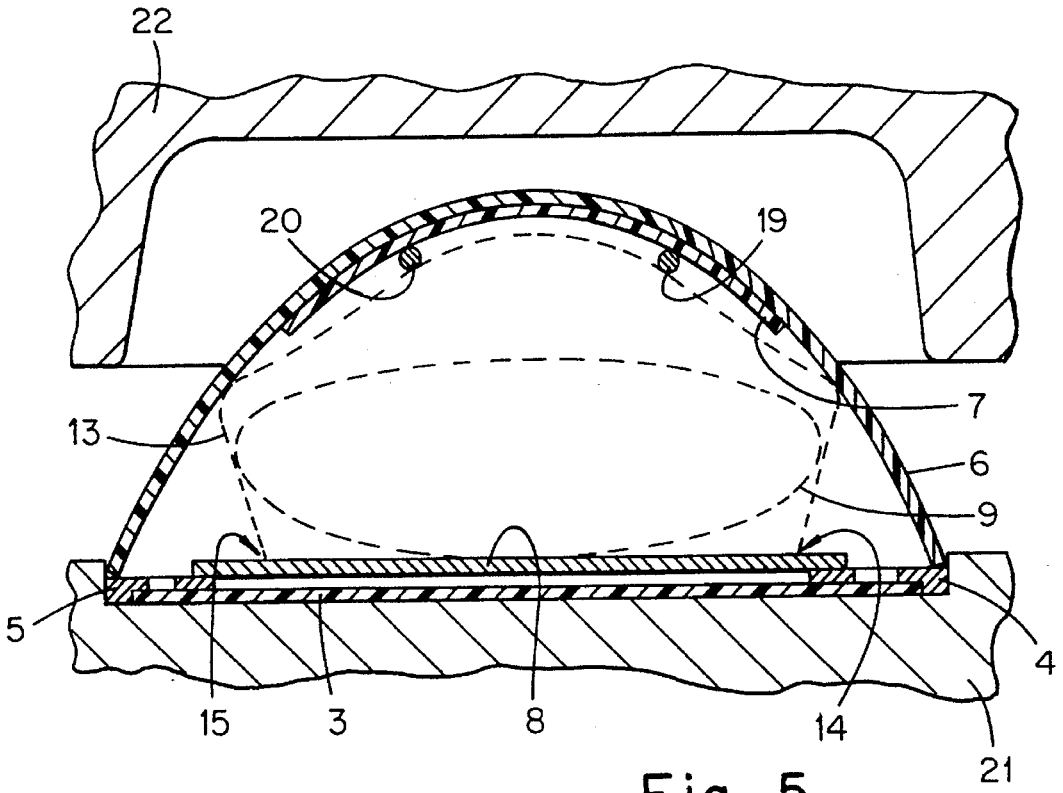
Fig. 5
Fig. 6
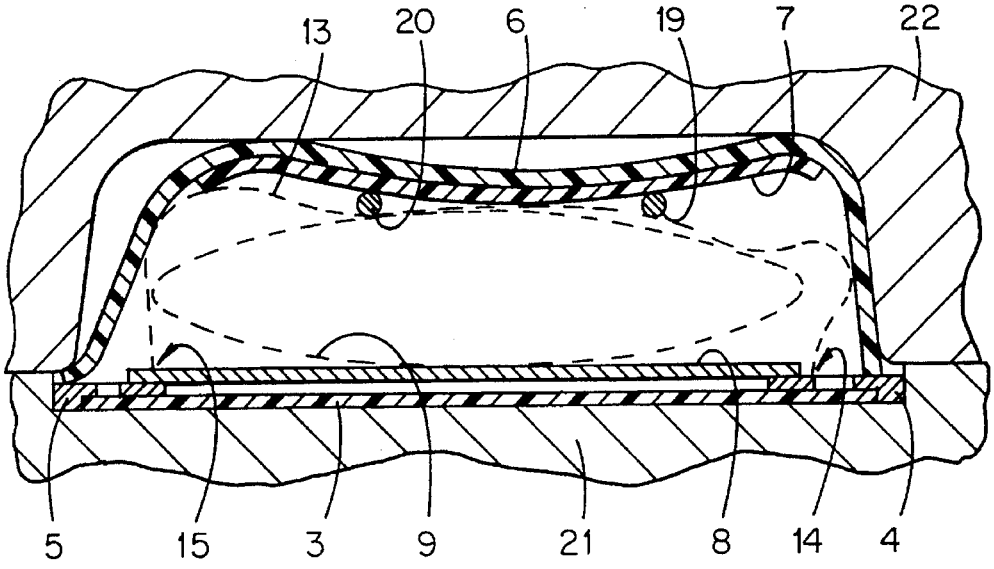

PROCESS FOR MANUFACTURING A SKI INCORPORATING AN INJECTED CORE AND A PERFORATED INTERNAL REINFORCEMENT, AND SKI OBTAINED BY THIS PROCESS

FIELD OF THE INVENTION

The present invention relates to a process for manufacturing a ski incorporating an injected core, for example having a core of injected polyurethane foam, a perforated fabric being embedded, as internal reinforcement, in this injected core. The invention also relates to a ski incorporating an injected core and a perforated internal reinforcing fabric, produced by this process.

BACKGROUND OF THE INVENTION

Skis incorporating a core of injected synthetic foam are relatively simple to manufacture.

To present good qualities of mechanical resistance and of performance on snow, a ski must be longitudinally flexible in order to follow the form of the terrain, in particular the hollows and bumps, whilst being sufficiently resilient to resume its initial form rapidly. On the other hand, it must be rathermore rigid in lateral bending in order always to conserve the shape of the line of edges which allows the ski to be controlled correctly in a turn.

By providing reinforcing members within the structure of the ski, and by acting on the nature, shape and positioning of these reinforcements, it is possible to modify the characteristics of this ski to adapt them to the use provided by the specifications: use in short turns, in large-radius turns, in downhill skiing, and the like.

The reinforcing members which may be embedded in the skis incorporating an injected core are, in the present state of the art, generally of the following different types:

- They may be metallic and made, for example of steel or aluminium alloy. In this case, they are in the form of plates, longitudinal rods, for example, in the form of piano strings, or of nettings.
- They may be fibrous and constituted, for example, by glass, carbon, or aramide fibers. In this case, they are in the form of plates, rods, pre-polymerized nettings, fabrics pre-impregnated with resin, or of dry fabrics.

One of the specific problems encountered in this technology of manufacturing skis with injected core "in situ" is the holding of the elements in position within the structure during the operation of injection.

Very schematically, the conventional process of manufacture consists of depositing against the walls of the mould the components which constitute the envelope of the ski (the base, edges, top . . . ), then injecting the expansible foam inside the cavity thus formed. It cannot really be claimed that a high-performance ski has thus been produced, as there are lacking inside such a structure the mechanisation elements necessary for responding to the above-mentioned characteristics of resistance and performance. To that end, it is necessary, as indicated hereinabove, to house in the cavity a sufficient quantity of judiciously positioned reinforcing elements.

The precision of the positioning of this type of reinforcement with respect to the neutral axis of the ski (axis on which no deformation is exerted during a bending stress on the ski) is very important, as a slight difference of the distance d which separates the reinforcement from this neutral axis has considerable effect on the rigidity of the ski in simple bending.

In fact, if, in a first approximation, the rigidity of the lateral faces with respect to local bending is neglected, the rigidity D to bending of a ski is expressed by the formula:

$$D=\tfrac{1}{2}.Ef.b.e.d^2$$

where:

Ef is the Young's modulus of the reinforcement b is the width of the reinforcement d is the distance of the reinforcement to the neutral axis of the ski e is the thickness of the reinforcement.

Finally, it is observed that this rigidity D is a function of the square of the distance d which separates the reinforcement from the neutral axis of the ski.

On the same pair of skis, it is important that the two skis have identical bending characteristics. In addition, these bending characteristics must be the same for all the skis of the same type. Finally, this results in the positioning of the internal reinforcements having to be precise in order to obtain the desired result as well as a good reproducibility of this result.

Injection technology being what it is, it is consequently necessary to find devices for maintaining the internal reinforcement(s) in a precise position during injection, despite the thrust due to the expansion of the polyurethane form necessary for homogeneous filling of the cavity.

This is why it has been provided to embed in the core of polyurethane (or other injectable synthetic matter), a flattened, perforated tube which is shaped from a polymerized resin netting of fairly great rigidity. This perforated tube then extends over virtually the whole length of the ski, roughly between the heel and the beginning of the tip. This tube is simply placed in the mould before the cover is closed. Its constituent netting presenting wide meshes, it offers no obstacle to the passage of the polyurethane and does not undergo substantial deformation during the operation of injection.

However, this reinforcing tube does not prove sufficient to give the ski the optimum quality of rigidity in bending and in torsion which are generally desired.

It is an object of the present invention to overcome all these drawbacks.

SUMMARY OF THE INVENTION

To that end, the invention relates to a process for manufacturing a ski incorporating a core of injected synthetic matter, this ski comprising an internal reinforcement which is embedded in the synthetic matter and which is constituted by a fabric of glass fiber or other fibrous material, this fabric being largely perforated and being, in addition, provided with a malleable metal armature of spaced apart metal wires, which is adapted to allow an easy, remanent pre-deformation of this fabric in order to give it, in advance, a desired shape, said process consisting in:

- preparing an assembly composed of a plurality of superposed, pre-assembled elements including, successively from top to bottom:
- the upper part of the ski at least composed of the plate constituting the possibly decorated protecting element of the ski,
- said reinforcing fabric pre-shaped as a tile and pre-assembled by adhesive force at a distance from this upper part thanks to the interposition of beads or pellets of a pasty, sticky product, such as a hot melt adhesive;

placing in the lower part of the mould the lower elements of the ski: typically, the edges, sole, possible lower reinforcing plate(s), and the like;

curving the upper assembly in the form of an upturned gutter to fit it in this lower part of the mould;

thereafter closing the mould with its cover of upturned U section, injecting the synthetic matter and, finally, proceeding with the conventional operations of cooling, opening of the mould, extraction, trimming and sanding of the ski.

According to a variant of this process, there is placed in the lower part of the mould, at the same time as said lower elements of the ski, another reinforcing member constituted by a perforated tube shaped from a netting.

The invention also relates to a ski incorporating a core of injected synthetic matter, said ski comprising an internal reinforcement which is embedded in the synthetic matter and which is constituted by a fabric of glass fiber or other fibrous material, this fabric being largely perforated and being, in addition, provided with a malleable metallic armature of spaced apart metal wires which is adapted to allow an easy, remanent pre-deformation of this fabric in order to give it, in advance, a desired shape, this ski being characterized in that said internal reinforcement is positioned at a distance from the inner face of the upper part of the ski which is constituted by at least the upper shell that the outer decorative element of the ski constitutes, and in that this internal reinforcement is separated from this same upper part of the ski by an upper reinforcing plate intended to promote screwing of the bindings and distance pieces which are constituted by beads or pellets of a pasty, sticky product, such as a hot melt adhesive, these distance pieces likewise being embedded in the synthetic matter.

This reinforced fabric reinforcement preferably has the general shape of a short upturned gutter, it has a length limited to some tens of centimeters, and, being located at the level of the runner zone, longitudinally embraces this runner zone to extend on either side thereof. If, for example, this runner zone extends over about 500 millimeters along the longitudinal axis of the ski, the reinforced fabric is placed beneath the upper reinforcing plate intended to promote screwing of the bindings, and its length is about 600 to 1200 millimeters, with the result that it projects, in the longitudinal direction, on either side of this runner zone, i.e. in fact this upper reinforcing plate.

In addition, this reinforced dry fabric is advantageously selected to be of a sufficient width for its two lateral edges to abut, directly or indirectly, on the respective two lateral edges of the ski. It thus constitutes, for the edges, a supporting element which opposes penetration thereof.

BRIEF DESCRIPTION OF THE DRAWINGS

The invention will be more readily understood on reading the following description with reference to the accompanying drawings, in which:

FIG. 5 shows these same elements partially pre-assembled and placed in the mould, before closure of the cover.

FIG. 6 shows these same elements in the mould, after closure of the cover but before injection of the synthetic matter.

DETAILED DESCRIPTION OF THE DRAWINGS

Figure 1:
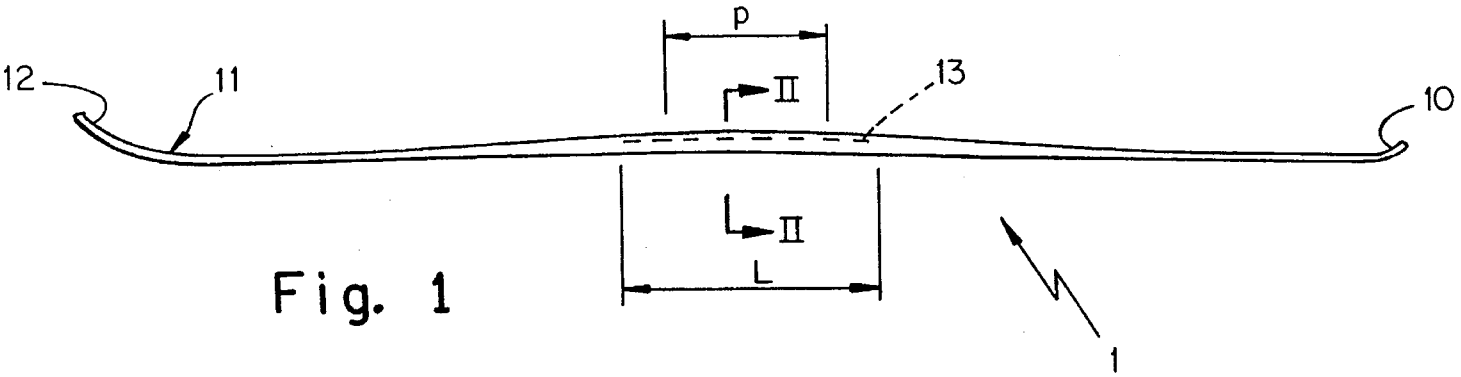
FIG. 1 is a side view of the ski according to the invention, making it possible to situate the zone where the perforated fabric reinforcement is placed.
Figure 2:
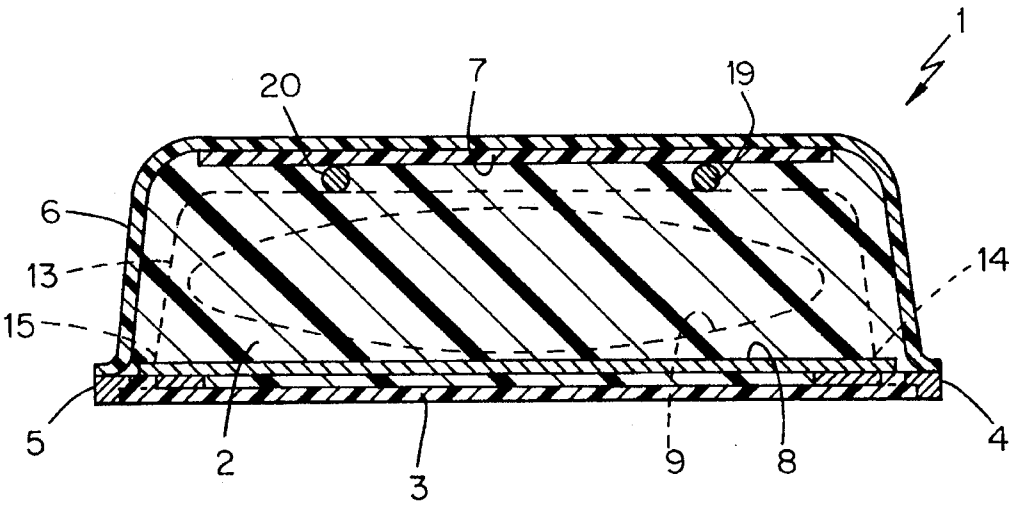
FIG. 2 is a transverse section of this ski, along II—II of FIG. 1.

Referring now to the drawings, FIGS. 1 and 2 firstly show a ski 1 with a core 2 of injected polyurethane foam. Such a ski is thicker and less wide at the level of the runner zone p, where the bindings are placed, than at its ends.

A ski of this type is, for example, composed of a sole 3 for slide, metallic lateral edges 4, 5, a core 2 of polyurethane or other matter, and of an outer shell 6, which is formed by at least one layer of thermoplastic matter and which bears the decorative pattern of the ski.

In the runner zone p, glued beneath the decorative element 6, there is provided an upper reinforcing blade 7, of rigid material such as a composite of glass fiber and of prepolymerized epoxy resin, which is intended to allow easy, firm screwing of the bindings.

A lower reinforcing blade 8 rests virtually on the two lateral edges 4, 5. This blade 8 is for example made of aluminium alloy.

The hold of this ski is,in manner known per se, already improved by the fact that a long, flattened, perforated fairly rigid tube 9 is embedded in the polyurethane foam 2. This tube 9 is for example manufactured from a netting of polymerized resin of fairly considerable rigidity. It extends virtually over the whole length of the ski 1, from the heel 10 to the beginning 11 of the tip 12.

In order to improve the resistance of this ski in particular in lateral bending as well as in torsion, another reinforcing element 13 is embedded in the polyurethane 2, at the level of the runner zone p. More precisely, this additional reinforcement 13 longitudinally embrace this runner zone p and is slightly longer than the latter, with the result that it exceeds it on either side in the longitudinal direction. Its length L is for example of the order of 500 to 1200 millimeters for a runner zone p 500 mm long.

The length L of this additional reinforcement 13 is generally of the order of some tens of centimeters. It is shaped as a short, upturned gutter.

Although this is not absolutely compulsory, this reinforcement 13 is chosen to be of a sufficient width for its two lateral edges 14 and 15 to be able to abut on the respective two lateral edges 4 and 5 of the ski 1. Consequently, this reinforcement 13 serves not only to improve the holding of the ski in lateral bending and in torsion, but, in addition, it serves as solid armature maintaining the edges 4 and 5, opposing penetration thereof.

Figure 3:
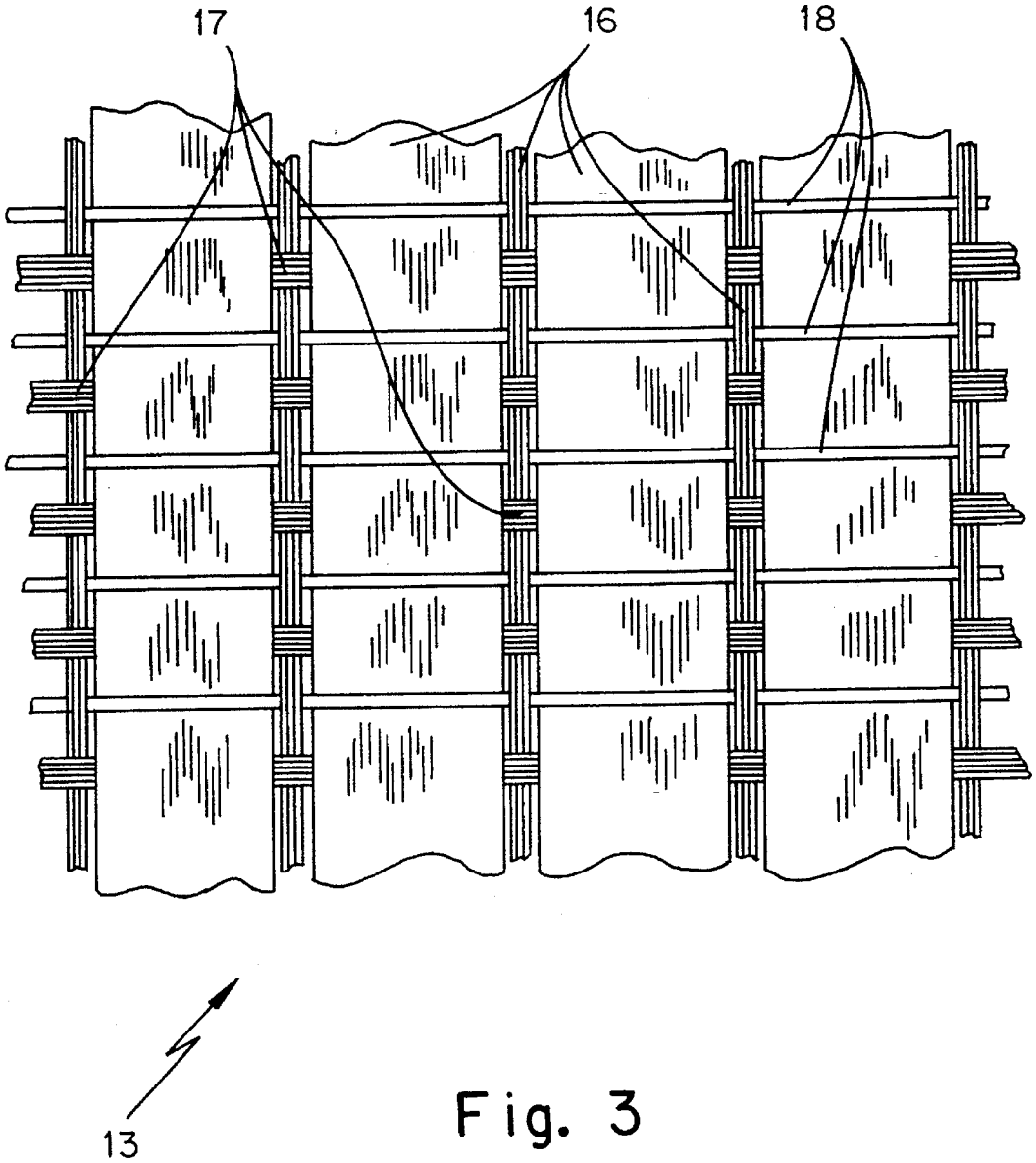
FIG. 3 is a plan view of a piece of reinforced fabric.

This reinforcement 13 is made of reinforced dry fabric, this fabric at present being currently used for the creation of water-tight shells, for example for the construction of swimming pools and pleasure boats. This reinforced dry fabric, which is therefore available on the market, is shown flat in FIG. 3.

It is question of a relatively perforated dry fabric made of glass fibers in the general case, which is very largely provided with warp (longitudinal) yarns 16 and very sparingly provided with weft (transverse) yarns 17. In addition, and this is an essential point, this dry fabric is reinforced with metallic weft yarns 18, which are relatively largely spaced apart from one another. This metal armature 18 makes it possible to give this fabric a remanent curvature, in transverse section. In a more elaborate form of this fabric, the filaments are still of glass fiber, but the fabric comprises more noble filaments such as aramide or carbon filaments.

The perforated nature of the fabric allows the passage of the polyurethane foam in order to embed the reinforcement 13 in the structure of the ski 1, and therefore to give this fabric all its mechanical qualities.

This reinforcement 13 is maintained at a distance from the lower surface of the shell 6 and more precisely at the level of the runner zone p of the plate 7, thanks to the prior interposition of distance pieces 19, 20 which are constituted by longitudinal beads of a pasty, sticky product, such as hot melt adhesive.

Moreover, the metal armature 18 of this fabric makes it possible to pre-form this fabric 13 in the form of a gutter.

Figure 4:
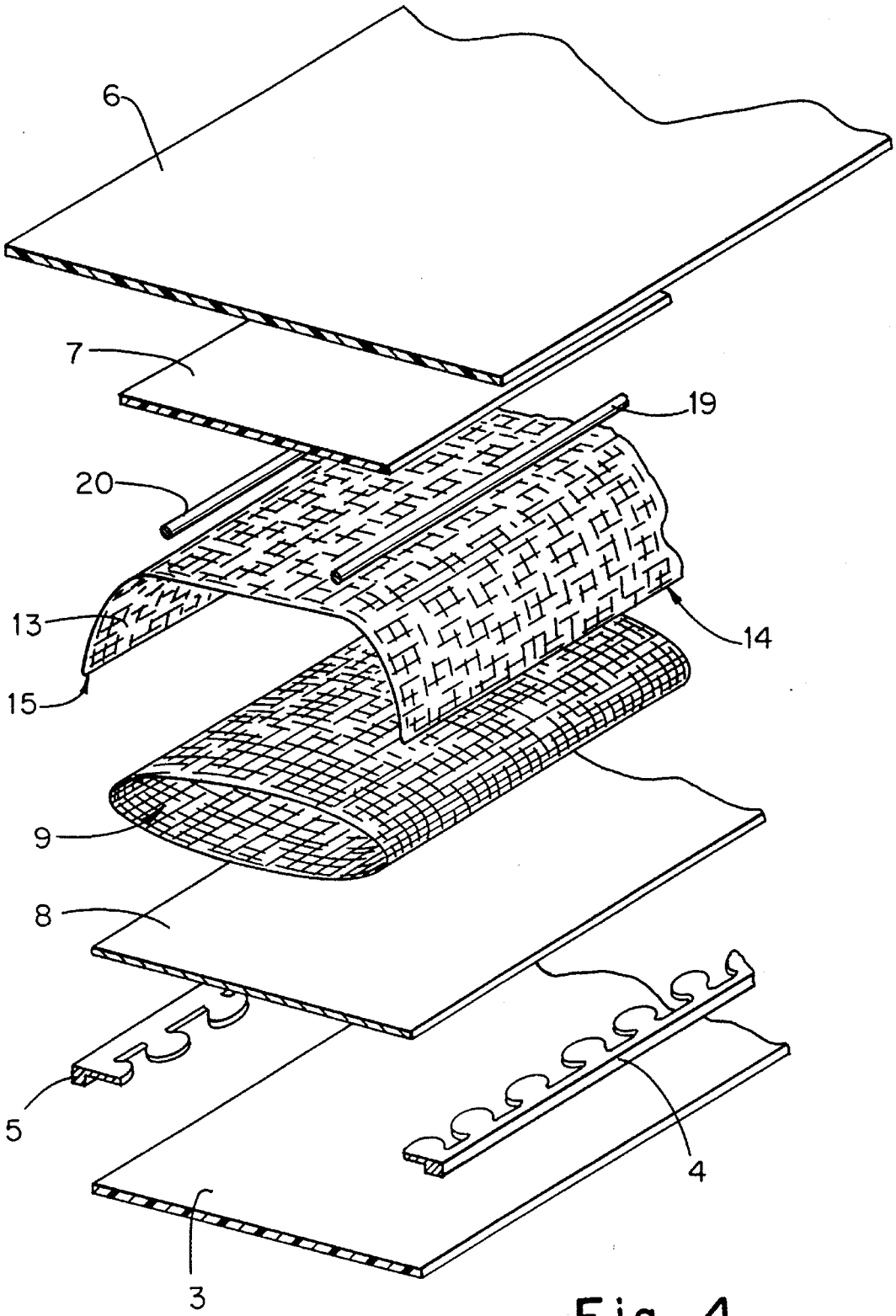
FIG. 4 is an exploded view of the elements constituting this ski, before partial pre-assembly and positioning in the mould for injection of synthetic matter.

FIG. 4 shows, very partially, at the level of the runner zone, all the elements constituting the ski before they are placed in the mould.

This Figure shows, successively from top to bottom: the decorative element 6 which is decorated flat beforehand, the upper reinforcing blade 7 which is intended to promote screwing of the bindings, the reinforced dry fabric 13, the perforated, flat tube 9, the lower reinforcement 8, the lateral edges 4 and 5, and the sole 3 for slide.

In addition, there are provided, between the reinforcing blade 7 and the dry fabric 13, and so as to maintain this dry fabric in the mould at a vertical distance from this blade 7, two beads 19 and 20 of a sticky, self-adhesive paste, of the hot melt type.

Referring to FIG. 5, the blade 7 is firstly glued in its place beneath the decorative plate 6, then the fabric 13 is shaped as an upturned gutter and is positioned, with the interposition of the adhesive beads 19 and 20, beneath the blade 7 and at a vertical distance therefrom. The sole 3, the edges 4, 5, the reinforcement 8 and the tube 9, then having been placed in position in conventional manner in the mould 21, the complex formed by the plate 6, the blade 7, the beads 19, 20 and the dry fabric 13 is then fitted in this mould 21 as shown, where it takes a shape fairly remote from its final shape.

The cover 22 of the mould is then positioned as shown in FIG. 6. At this stage, the various elements, compressed by this cover 22, take, there again, an approximate shape as shown in this FIG. 6.

Figure 7:
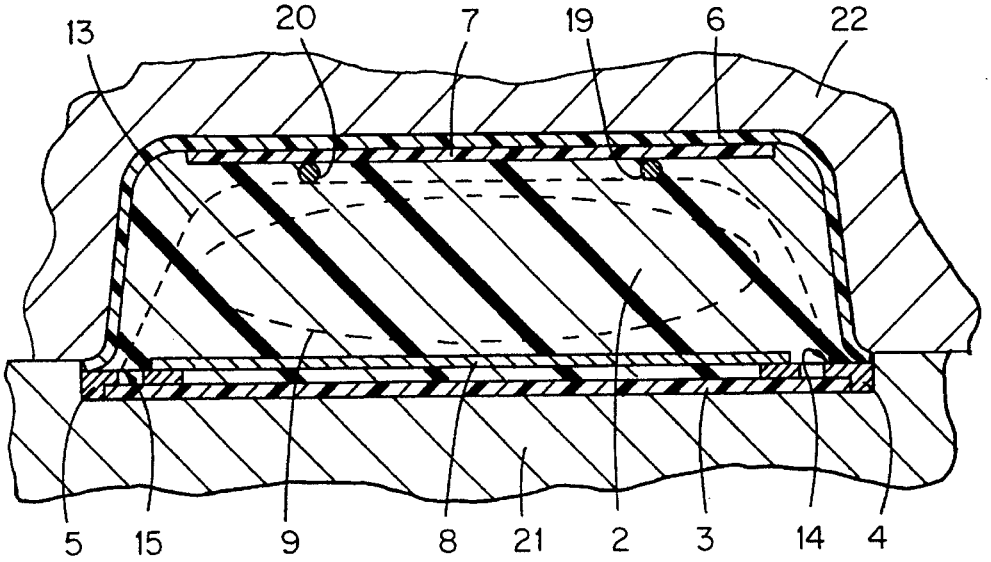
FIG. 7 shows the final position adopted by all these elements after injection of this synthetic matter.

The polyurethane foam 2 is then injected, passing through the perforated elements 9 and 13, applying the shell against the walls of the mould 21, 22, correctly repositioning the various internal elements of the ski to give them their definitive shape, as shown in FIG. 7.

After the polyurethane has hardened then cooled, the cover 22 is withdrawn and the Ski may be taken out of the mould and subjected to the finishing operations: trimming, sanding, and the like.

It goes without saying that the invention is not limited to the embodiment which has just been described.

Figure 8:
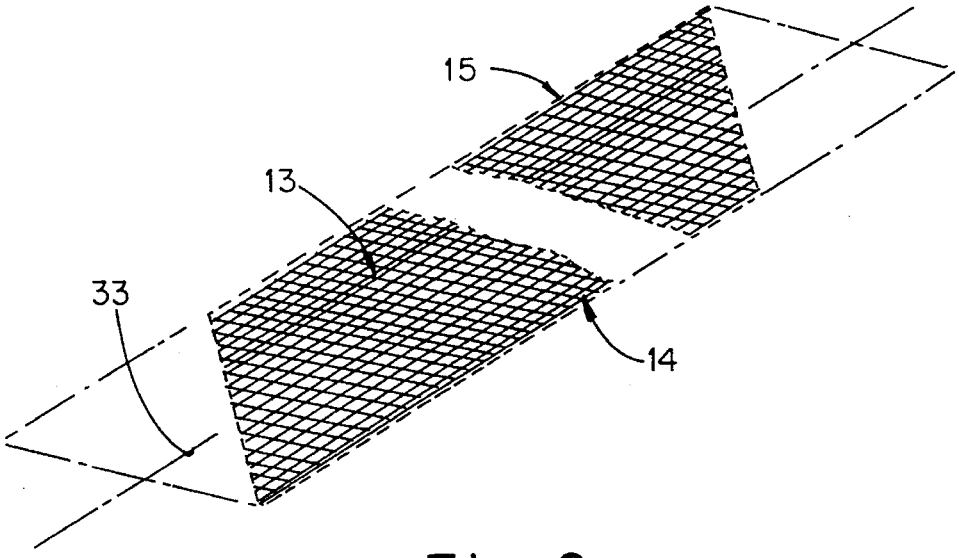
FIG. 8 illustrates another possible cut-out for the dry fabric plate, such cut-out enabling a variant embodiment of the ski to be produced.

In that example, the fabric 13 was originally cut out in a rectangular shape. It may be cut otherwise and, according to FIG. 8, this cut-out may take the shape of a non-rectangular parallelogram. The ski 1 would then present a right-left asymmetry, which may be advantageous in certain cases. Of course, it should be noted that such right-left dissymmetry may be given to the ski by giving this fabric 13 an asymmetry with respect to the median longitudinal axis 33 of the ski which would be due to any shape other than that of a non-rectangular parallelogram.

Figure 9:
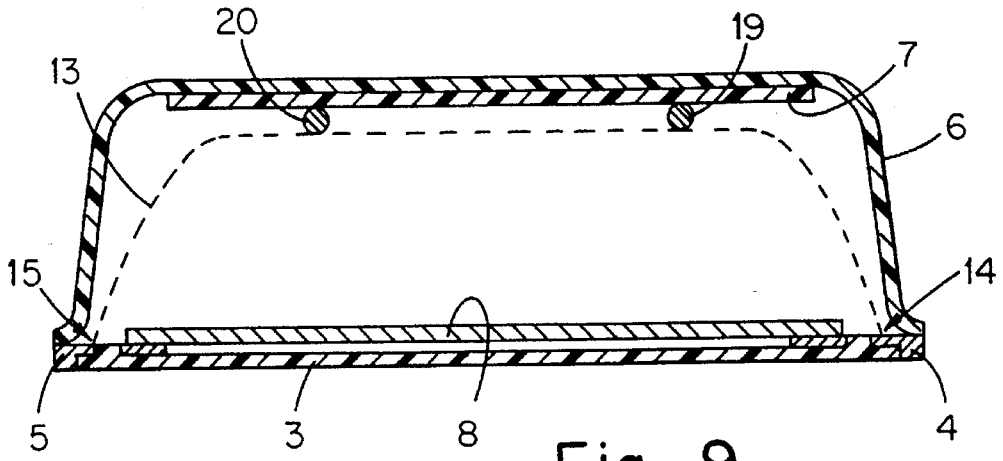
FIGS. 9 to 11 are views similar to FIG. 2 and illustrating other variant embodiments of the ski.

According to FIG. 9, this ski need not comprise the tubular net reinforcement 9 described hereinabove, but solely the reinforcement 13 which in that case might possibly be a little longer.

Figure 10:
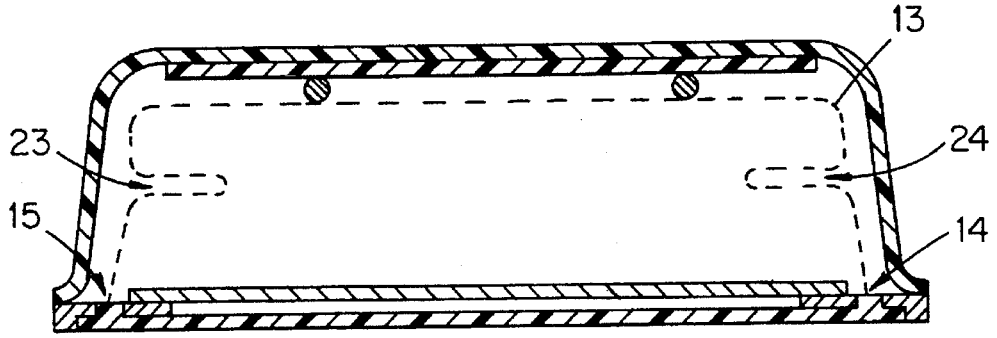

According to FIG. 10, this same reinforcement 13 may be Shaped to present one or more lateral folds 23, 24 adapted considerably to reinforce its solidity at the level of the lateral faces of the ski, which has for its effect considerably to reinforce the structure in lateral bending. These folds 23, 24 are positioned substantially at the level of the neutral axis of the ski.

Figure 11:
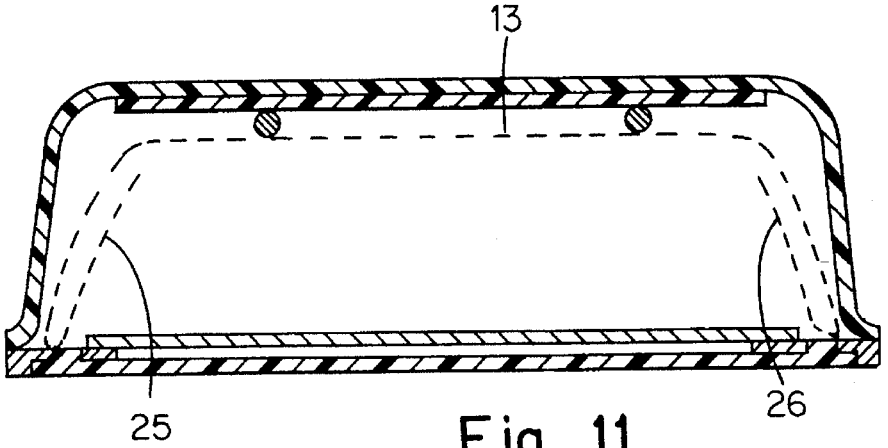

This same effect of accentuated reinforcement in lateral bending may also be obtained, according to FIG. 11, by shaping the fabric to create, laterally, one or more returns 25, 26 which would at least double the thickness of each of the lateral faces of the gutter 13.

Figure 12:
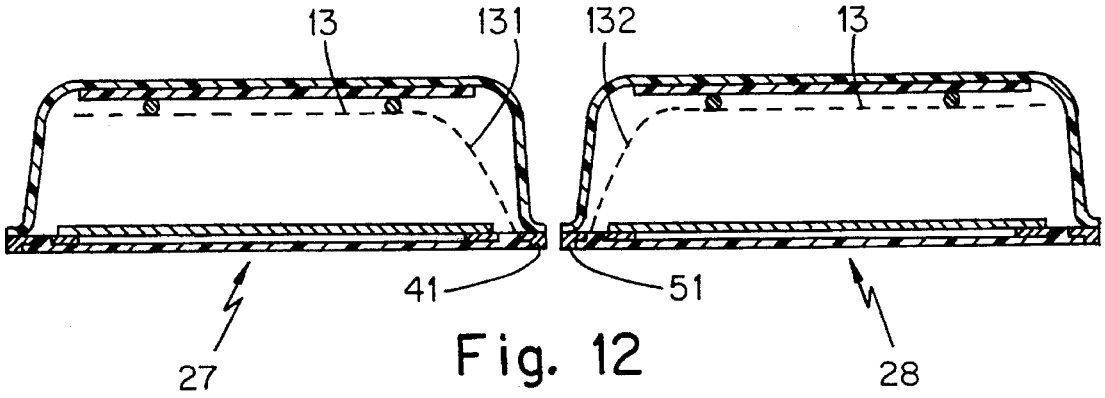
FIGS. 12 and 13 are views in section, similar to FIGS. 9 to 11, but made on the two skis of the same pair in accordance with two other variant embodiments.

In order to economize in manufacturing costs and taking into account the fact that, for a pair of skis, it is essentially the inner edges which are under strain when the skis are used, it is possible to provide, for the reinforcement 13 of perforated, reinforced fabric, an asymmetrical positioning adopting a recumbent L shape, according to FIG. 12, this fabric in that case comprising, for each ski of the same pair 27, 28, only one lateral face, 131 and 132 respectively, provided solely on the internal edge side 41 and 51 respectively.

Figure 13:
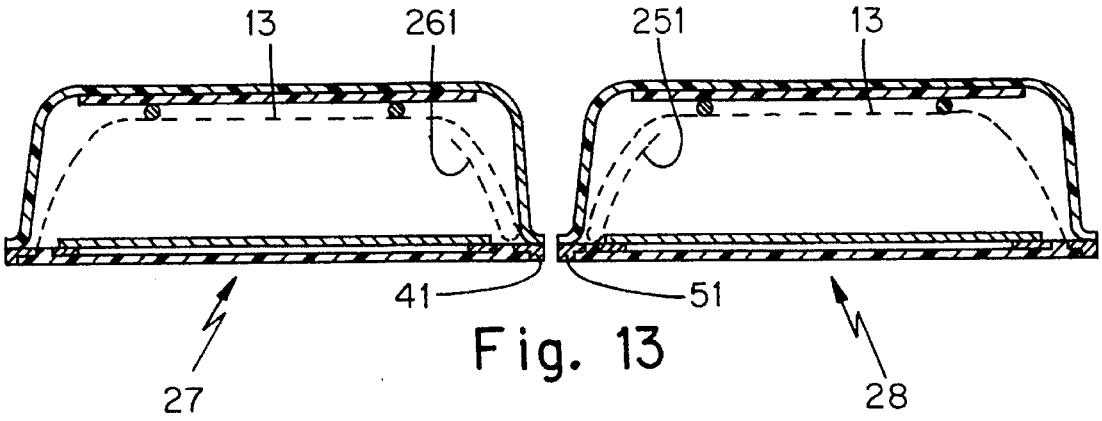

Similarly, these two reinforcements 13 may, for the two skis 27, 28 of the same pair, each present, according to FIG. 13, one return 261 and 251, respectively, each of these returns being identical to returns 25 and 26 of FIG. 11 and the reinforcement 13 may furthermore conserve the shape of an upturned gutter of asymmetrical appearance as it is thicker on one of its lateral faces. More generally, the reinforcement 13 may be shaped or positioned so as to present more matter towards the internal edge of each ski of the same pair.

What is claimed is:

1. A ski comprising:

a core of injected synthetic material;

an internal reinforcement member embedded in said core, said member comprising a largely perforated fabric of fibrous material having a malleable metallic armature of spaced apart metal wires which provide easy, remnant pre-deformation in order to pre-shape said member; and spacer members embedded in said core for positioning said internal reinforcement member within said core a distance from an upper part of said ski, said upper part including at least an upper shell of said ski, said spacer members comprising one of beads and pellets of a pasty, sticky material.

2. The ski of claim 1, wherein said fibrous material comprises glass fibers.

3. The ski of claim 1, wherein said spacer members comprise a hot melt adhesive.

4. The ski of claim 1, wherein said internal reinforcement member has the shape of a short overturned gutter.

5. The ski of claim 1, wherein said internal reinforcement member is located at the level of a runner zone.

6. The ski of claim 1, wherein said internal reinforcement member has a length of about 500 to 1200 millimeters.

7. The ski of claim 1, wherein said internal reinforcement member longitudinally embraces a runner zone of said ski to extend slightly on either side thereof.

8. The ski of claim 7, wherein said runner zone has a length on the order of 500 millimeters and said internal reinforcement member is placed beneath an upper reinforcing plate of said ski, and the length of said internal reinforcement member is about 600 to 1200 millimeters.

9. The ski of claim 1, wherein said internal reinforcement member has a sufficient width for its two lateral edges to abut, directly or indirectly, on the respective two lateral edges of said ski.

10. The ski of claim 1, wherein said internal reinforcement member has a shape which is asymmetrical with respect to the median longitudinal axis of the ski.

11. The ski of claim 1, wherein said internal reinforcement member is positioned in an asymmetrical manner with respect to the median longitudinal axis of the ski.

12. The ski of claim 1, wherein said internal reinforcement member is shaped to present at least one lateral fold.

13. The ski of claim 12, wherein said at least one lateral fold is positioned substantially medially between upper and lower surfaces of said ski.

14. The ski of claim 1, wherein said internal reinforcement member is shaped in order laterally to create at least one return at least doubling the thickness of at least one of the lateral faces of said internal reinforcement member.

15. The ski of claim 1, wherein said internal reinforcement member is shaped or positioned so as to present more of said member towards the inner edges of each ski of the same pair.

16. The ski of claim 1, further comprising another reinforcement member embedded in said core, and comprising a tube in the form of a netting, said tube being positioned beneath said internal reinforcement member.

* * * * *